US006964698B1

(12) United States Patent
Davis et al.

(10) Patent No.: US 6,964,698 B1
(45) Date of Patent: Nov. 15, 2005

(54) GAS SUPPLY FOR ELECTROSTATIC FILTER AND ELECTROSTATIC FILTER ARRANGEMENT

(75) Inventors: Thomas Davis, Bursheid (DE); Hans Ruscheweyh, Aachen (DE); Michael Kaatz, Ratingen (DE); Stefan Leser, Neuss (DE)

(73) Assignee: Balcke-Durr GmbH, Ratingen (DE)

( * ) Notice: Subject to any disclaimer, the term of this patent is extended or adjusted under 35 U.S.C. 154(b) by 39 days.

(21) Appl. No.: 10/910,638

(22) Filed: Aug. 4, 2004

(30) Foreign Application Priority Data

Jun. 7, 2004 (EP) ..... 04013364

(51) Int. Cl.[7] ..... B03C 3/013
(52) U.S. Cl. ..... 96/52; 96/61; 96/64; 96/74
(58) Field of Search ..... 96/52, 53, 61, 96/64, 74, 314, 319; 95/64, 65, 71, 72, 78; 55/345; 261/79.2

(56) References Cited

U.S. PATENT DOCUMENTS

| | | | | |
|---|---|---|---|---|
| 1,381,719 | A * | 6/1921 | McGee et al. | 95/69 |
| 3,425,189 | A * | 2/1969 | Haselmayer | 96/64 |
| 3,831,350 | A | 8/1974 | Gilles et al. | 96/62 |
| 4,141,698 | A * | 2/1979 | Kihlstedt et al. | 95/69 |
| 4,170,555 | A * | 10/1979 | Vicard | 210/788 |
| 4,208,192 | A * | 6/1980 | Quigley et al. | 95/2 |
| 4,649,703 | A * | 3/1987 | Dettling et al. | 60/275 |
| 4,971,768 | A | 11/1990 | Ealba et al. | 422/176 |
| 5,156,658 | A * | 10/1992 | Riehl | 96/64 |
| 5,591,334 | A * | 1/1997 | Shimizu et al. | 210/243 |
| 5,855,652 | A * | 1/1999 | Talley | 96/44 |
| 5,914,454 | A * | 6/1999 | Imbaro et al. | 95/64 |
| 5,968,231 | A * | 10/1999 | Parmentier et al. | 95/28 |
| 6,017,381 | A * | 1/2000 | Dunn et al. | 95/3 |
| 2002/0014707 | A1 * | 2/2002 | Zamany | 261/79.2 |

FOREIGN PATENT DOCUMENTS

| | | | |
|---|---|---|---|
| EP | 0 288 351 | * 10/1988 | 96/61 |
| EP | 0638732 | 2/1995 | |
| GB | 1096624 | 12/1967 | |

* cited by examiner

*Primary Examiner*—Richard L. Chiesa
(74) *Attorney, Agent, or Firm*—Baker & Hostetler LLP

(57) ABSTRACT

The invention relates to a gas supply for an electrostatic filter and an electrostatic filter arrangement which has an electrostatic filter and a gas supply. Here, the gas supply has an incoming flow channel of constant cross-sectional area, a gas inlet hood with cross-sectional area expanding in the direction of the electrostatic filter, and an admixture arrangement for a conditioning means, wherein at least one flow distributor is arranged in the expanded cross-sectional region of the gas inlet hood. Characterizing features include a first vortex arrangement generating a leading-edge vortex arranged in the incoming flow channel, a second vortex arrangement generating a leading-edge vortex arranged in the gas inlet hood before the flow divider in the gas flow direction, and the admixture arrangement arranged in the region of one of the two vortex arrangements.

12 Claims, 1 Drawing Sheet

GAS SUPPLY FOR ELECTROSTATIC FILTER AND ELECTROSTATIC FILTER ARRANGEMENT

FIELD OF THE INVENTION

The invention relates to a gas supply for an electrostatic filter and to an electrostatic filter arrangement, which has an electrostatic filter and a gas supply.

BACKGROUND OF THE INVENTION

Electrostatic filters are used, among other places, in garbage-incinerating facilities, power plants, or in industry in fired production plants, such as for cement, lime, gypsum, iron, or steel manufacturing, in order to filter solid particles that are difficult to separate, e.g., fine dust particles, from a flow of air, flue gas, or, in general, a gas. For this purpose, the gas flow is led through an electric field, in which electrons released by electrodes attach to the dust particles, travel together with the dust particles in the direction of collecting electrodes, where they are separated.

So that an electrostatic filter can clean the gas with the greatest possible efficiency, it must flow into or through the filter as uniformly as possible. A non-optimal flow into the filter leads to a nonuniform distribution of the dust, the temperature, or the flow rate in the gas flow, which results in reduced filtration efficiency and thus nonoptimal cleaning effect. Due to this nonuniform flow distribution, particle deposits can form very easily, which slowly reduce the cross section of the flow in the electrostatic filter and decrease its efficiency.

Thus, an electrostatic filter arrangement typically has a gas supply which is arranged ahead of the electrostatic filter and which guides the gas to be filtered as uniformly as possible towards and into the filter. The gas supply usually includes an incoming flow channel, through which the gas flows in the direction of the filter, and a gas inlet hood, which expands from the incoming flow channel to the electrostatic filter approximately in the shape of an inverted funnel. The gas inlet hood thus has a small cross-sectional area, which corresponds to the incoming flow channel, at its cross section at the front in the direction of flow and a large cross-sectional area, which essentially corresponds to that of the electrostatic filter, at its cross section at the back in the direction of flow.

To make the flow into the filter uniform, at least one flow distributor is arranged in the gas supply, normally directly before the electrostatic filter in the expanded region of the gas inlet hood. These flow distributors are typically gas distribution arrangements in the form of perforated plates, which are often arranged one behind the other in several layers.

For further improvement of the filter performance, or simply to create the initial conditions necessary for filtration in the gas to be filtered, conditioning means are mixed into the gas flow in the gas supply with the aid of an admixture arrangement. One example is cooling conditioning, for which water is sprayed into the gas flow to cool the gas. The gas is also often conditioned without reducing the gas temperature by injecting $SO_3$, $NH_3$, water vapor, or the like into the gas to be filtered, among other things, for reducing the electrical resistance of the dust. To achieve as uniform an admixture as possible, the admixture arrangement usually has a plurality of nozzles arranged in the gas supply.

These known electrostatic filter arrangements have already proven to be very effective in the past. However, against the background of increasingly stricter requirements for emission protection of filtration systems, there is nevertheless still a great demand for electrostatic filter arrangements which exhibit an improved efficiency relative to this state of the art.

SUMMARY OF THE INVENTION

Therefore, the invention is based on the task of improving the efficiency of electrostatic filter arrangements.

This task is successfully realized with the gas supply for an electrostatic filter and the electrostatic filter arrangement.

Accordingly, the invention first relates to the gas supply for an electrostatic filter of an electrostatic filter arrangement, because, according to studies by the inventor, there is particularly great potential for improving the efficiency of the electrostatic filter arrangement, even in the region of the gas inlet to the filter. Here, the gas supply is basically a known gas supply, which has an incoming flow channel with constant cross-sectional area, a gas inlet hood with cross-sectional area expanding in the direction of the electrostatic filter, and an admixture arrangement for a conditioning means. Here, at least one flow distributor is arranged in the expanded cross-sectional region.

The gas supply according to the invention now distinguishes itself from known gas supplies in that a first vortex arrangement generating a leading-edge vortex and a second vortex arrangement generating a leading-edge vortex are arranged in the gas inlet hood ahead of the flow distributor in the direction of gas flow and the admixture arrangement is arranged in the region of one of the two vortex arrangements. These vortex arrangements are basically known built-in elements, as have been previously described, e.g., in EP 0638732 A1, for a diffuser.

The essential feature of these vortex arrangements is that they generate leading-edge vortices. These edge vortices, which are also designated as vortex drags, can be envisioned as small tornadoes, which are directed in the direction of flow and whose diameter grows in the direction of flow. Here, the vortices rotate from the side edges of the vortex arrangement initially outwards and then roll inwards, wherein opposing vortices rotate in the opposite sense. If one looks downstream at such a vortex arrangement, the leading-edge vortices appear as two spirals rolling in opposite directions.

These leading-edge vortices have the advantage that they are extremely stable vortex systems, which lead to an especially effective thorough mixing of the gas flow. Therefore, it is possible for a turbulent flow behavior that is as uniform as possible to be formed behind such a vortex arrangement, which can be set nearly independently of the amount of gas flow at that time. Thus, such vortex arrangements do not have to be constantly adapted to fluctuating amounts of gas. In this connection, one thus speaks of static mixers. Due to these good, thorough mixing properties, vortex arrangements generating leading-edge vortices have been used, especially in diffusers, to completely replace conventional deflection plates, guide plates, or perforated plates, which are used for flow distribution or deflection.

Until now, such vortex arrangements were not used in electrostatic-filter arrangements or gas supplies for electrostatic filters, because they were not considered suitable for this application to completely replace the flow distributor (perforated plates). In particular, the greatly expanding gas inlet hood previously appeared to be too short for the use of such leading-edge vortices to effectively produce a uniform flow.

In contrast, here the vortex arrangements are also inserted in the greatly expanded gas inlet hood of a gas supply for an electrostatic filter, but unlike before, they are not used to replace completely the flow-distributing built-in elements, for example, the flow distributor, but instead only to improve its incoming flow behavior, at least in sections.

More specifically, this means that the flow into the flow distributor arranged ahead of the electrostatic filter is optimized so that only a single perforated sheet layer is necessary, and not two or three, as before. In this way, the vortex arrangements have only a very minimal projection area in the direction of flow for a high vortex effect due to their placement diagonally in the direction of flow, wherein the pressure losses are greatly reduced. At the same time, a strong vortex effect is produced, such that the particles move greatly and do not collect as easily as before. At the same time, the vortex effect breaks apart and distributes dust bundles, so that the dust particle distribution becomes uniform. Also, due to the turbulent but uniform flow, the flow distribution to the electrostatic filter can be achieved just with a single perforated plate layer. Therefore, the built-in surfaces in the gas supply are reduced and the efficiency of the electrostatic filter or the electrostatic filter arrangement is increased significantly overall, while the flow into the electrostatic filter, which is basically judged to be advantageous, can be maintained by the perforated plate.

In addition, the gas supply according to the invention is characterized in that a vortex arrangement is arranged in the incoming flow channel with at least approximately constant cross section. Thus, first leading-edge vortices are formed already in the tubular section with essentially parallel channel walls. This arrangement stands in contrast to prior teaching, which assumed that the vortex arrangements should always be arranged within the expanding regions of a diffuser. It is based on a synergistic effect, which is produced by keeping at least one flow distributor ahead of the electrostatic filter.

Studies by the inventor have shown that the preferred arrangement of the first vortex arrangement in the incoming flow channel generates a sufficiently advantageous flow distribution even for electrostatic filters, if another vortex arrangement and a flow distributor, thus a perforated plate, follow in succession. Therefore, it is possible, e.g., also under the aid of simple or conventional deflection plates, to direct the basically already turbulent and thoroughly mixed gas flow in the gas inlet hood in the direction of the flow distributor, which then guarantees the uniform flow through the electrostatic filter.

Especially advantageous is that now the admixture arrangement is arranged in the region of one of the two vortex arrangements. Thus, the strong leading-edge vortices can be used for effective admixture of a conditioning means into the gas flow. Due to the leading-edge vortex systems expanding in the direction of flow, an especially good mixing of the conditioning means over the flow cross section is achieved, also for point-wise injection.

The first vortex arrangement is arranged ahead of a bend in the incoming flow channel in the direction of the main flow. This has the advantage that the first vortex arrangement is also used for deflecting the gas flow in the direction of the bend in the incoming flow channel.

In this way, the first vortex arrangement is preferably arranged closer to the inside of the bend in the incoming flow channel than to the outside of the bend, thus asymmetrically towards the inner side of the bend relative to the center of the incoming-flow channel. Therefore, an increased amount of flow energy is fed to the inner side, which better enables the flow to follow the sharp deflection of the inner edge. In interaction with the second vortex device, it is thus possible to achieve a nearly separation-free deflection in the filter hood, which significantly improves the flow distribution.

Basically, the first vortex arrangement can be arranged at an angle in the incoming flow channel, such that the incoming flow edge of at least one incoming flow surface facing the gas flow points in the direction of the inside of the bend and the separation edge points to the outside of the bend in the incoming flow channel. However, it is preferred that the first vortex arrangement be arranged differently in the incoming flow channel at an angle, so that the incoming-flow edge of at least one incoming flow area facing the gas flow points in the direction of the outside of the bend and the separation edge points to the inside of the bend in the incoming flow channel. In this way, the incoming flow edge is the edge of the vortex arrangement which faces the gas flow, and the separation edge is the edge which faces away from the flow. In other words: the vortex process is triggered at the incoming flow edge and, at the outgoing flow edge, the gas flow leaves the incoming flow surface. This configuration produces an especially strong leading-edge vortex system at the separation edge, which extends very far into the region of the outside of the bend in the incoming flow channel.

It is advantageous when the second vortex arrangement is arranged in a lower region of the gas inlet hood. This has the effect that particularly the lower region of the gas inlet hood is thoroughly mixed with leading-edge vortices, so that dust particles, which move downwards due to their weight, do not collect on the floor of the gas inlet hood, but instead are mixed back into the gas flow turbulently before the filter. This reduces particle deposits collecting on the floor of the gas inlet hood and leads to significant improvement of the electrostatic filter efficiency. In addition, for a vertical incoming flow channel, the air flow which is deflected in the horizontal direction due to a bend is again led through the second vortex arrangement in a horizontal direction. The vortex arrangement is thus used not only as means for thorough mixing, but also as deflection means.

Preferably, the second vortex arrangement is arranged at an acute angle to a wall of the gas inlet hood. Here, an acute angle should be understood to be an angle of less than 45° and greater than 0.5°. Therefore, a well-developed leading-edge vortex system is generated at the incoming flow channels of the vortex arrangement.

Especially preferred, the admixture arrangement opens behind the incoming flow edge of a vortex arrangement. Therefore, very simple admixture arrangements can also be used, e.g., a simple connecting piece which opens behind the incoming-flow edge of a vortex arrangement. Due to the strong vortices forming at the incoming flow edge and expanding like a cone in the direction of flow, a very good mixing of the conditioning means output through the connecting piece with the passing gas is achieved, even for only a point-wise admixture. Here, embodiments for which the admixture arrangement is attached directly to the vortex arrangement are also preferred.

A vortex arrangement should have at least one vortex disk. Vortex disks have been known for a long time and can be in the form of a circle, ellipse, rectangle, or also a delta wing, wherein disks in straight or bent configurations or also with triangular or droplet-shaped cross-sectional configurations are suitable.

A vortex arrangement has several vortex disks arranged one next to the other in a flow cross section. Here, the vortex disks can be concatenated or also mounted individually to the wall. Vortex arrangements can also be concatenated around the entire cross section. This means that for a rectangular incoming flow channel, at least one vortex disk is arranged at the top, bottom, left, and right.

Preferably, a vortex arrangement has several cascading vortex disks. Here, "cascading" should be understood as a functional sequence of vortex disks arranged one behind the other. Therefore, this produces an image of steps, wherein inclined or diagonally-offset arrangements of the individual vortex disks are also conceivable. What is important is only that the gas flow be led from one vortex disk to the next, creating an optimal induction effect.

It is also preferred that a vortex arrangement have a system composed of several vortex disks. Such a vortex disk system can consist, e.g., of a plurality of vortex disks which are arranged on a common pivot axis. Thus, the effect of several vortex disks can be changed at the same time in their functional relationship fixed relative to each other, e.g., through rotation or pivoting.

According to the invention, the task is also accomplished by an electrostatic filter arrangement which has an electrostatic filter and a gas supply according to one of the previously mentioned embodiments and refinements. This electrostatic-filter arrangement is distinguished particularly by the use of vortex disks using the previously described means and methods producing the advantages already described in the preceding embodiments of the gas supply.

BRIEF DESCRIPTION OF THE DRAWINGS

The invention will be explained in more detail below with reference to a drawing. Shown schematically is.

DETAILED DESCRIPTION OF THE INVENTION

Figure 1:
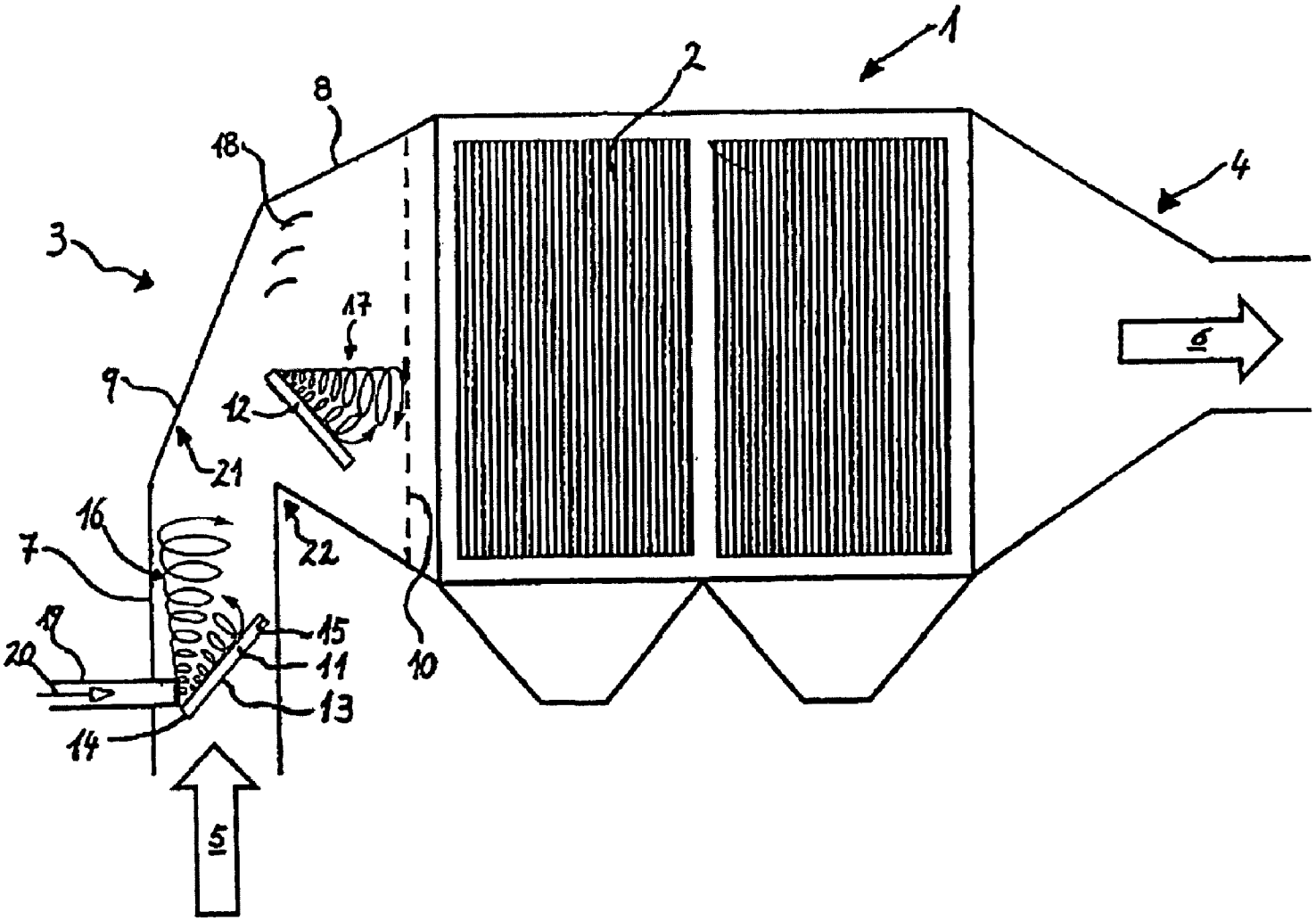
FIG. 1, a longitudinal section through an electrostatic filter arrangement, which has an electrostatic filter and a gas supply.

The embodiment of the electrostatic filter arrangement 1 according to the invention shown in FIG. 1 has an electrostatic filter 2, a gas supply 3, and a gas discharge 4. During operation of the electrostatic filter arrangement 1, the gas supply 3 carries a gas flow 5 to be filtered and deflects this gas from a vertical direction into an essentially horizontal direction, directing it to the filter 2. In the filter 2, the gas flow 5 to be filtered is then freed of particles contained in the gas by the aforementioned electrical processes and is output by the gas discharge 4 as filtered gas flow 6 from the electrostatic filter arrangement 1.

In this embodiment, the gas supply 3 thus contains a vertical incoming flow channel 7 with essentially constant flow cross section. A bend 9 in the incoming flow channel connects to the incoming flow channel 7 in the direction of main flow. Here, the gas flow 5 to be filtered changes its direction of flow from a vertical direction to a horizontal direction.

The gas inlet hood 8, which expands in cross section in the direction of filter 2, then follows the curved incoming flow channel section 9. The flow distributor 10, which is here a simple perforated plate, is located directly before the electrostatic filter 2, thus in the region of the largest cross-sectional area of the gas inlet hood 8.

A first vortex arrangement 11 generating a leading-edge vortex is arranged in the incoming flow channel 7 before the curved section 9. The second vortex arrangement 12 generating a leading-edge vortex is located in the narrow region of the gas inlet hood 8, thus in the direction of flow before the perforated plate 10. In the embodiment shown here, each vortex arrangement is a single circular vortex plate which has an incoming flow surface 13 on its side facing the gas flow. The incoming flow surface 13 connects the upstream incoming flow edge 14 and the downstream separation edge 15.

Here, the first vortex plate 11 is arranged before the bend 9, so that the incoming flow surface 13 extends in the direction of flow from the outside 21 of the bend to the inside 22 of the bend 9. For the very sharp bend 9 shown here, the outside 21 of the bend is thus the diagonally upwards plate, while the inside 22 of the bend corresponds to the corner or the transition between the incoming flow channel 7 and the gas inlet hood 8.

In detail, the first vortex plate 11 is arranged so that the incoming flow edge 14 is directed downwards, thus against the gas flow 5 to be filtered, and the separation edge 15 points upwards. The incoming flow surface 13 thus extends from the incoming flow edge 14 diagonally upwards to the separation edge 15 in the shown longitudinal section.

At this vortex arrangement 11 receiving a diagonal flow, behind the incoming flow edge 14, a well-developed leading-edge vortex system 16 is formed, which spreads vertically upwards from the incoming flow edge 14 in the direction of main flow 5. Here, the diameter of the leading-edge vortex 16 increases perpendicularly to the direction of main flow of the gas flow 5. Corresponding conditions also apply for the second vortex plate 12, where a leading-edge vortex system 17 is likewise formed, wherein the leading-edge vortex system 17 essentially directs the flow onto the perforated plate 10 to be approximately horizontal.

For uniform deflection of the gas flow 5 from the vertical towards the horizontal, deflection plates 18 of a conventional curved structure are located in the gas inlet hood 8 in the top region. They merely supplement the directional change of the gas flow already generated by the vortex arrangement 11 and, in particular, are not used for the vortex formation.

For conditioning the gas 5 to be filtered, a connecting piece 19 is arranged in the incoming flow channel 7 and definitely in the region of the incoming flow edge 14 of the first vortex plate 11. A conditioning means 20 can be injected into the incoming flow channel by means of this connecting piece. Due to the strong vortex effect of the gas flow in the vortex 16 propagating downstream, an especially thorough mixing of the gas with the conditioning means 20 is achieved, so that a complicated multi-nozzle admixture arrangement can be eliminated. This reduces the flow resistance and the manufacturing costs and makes the admixture arrangement 19 less susceptible to interferences resulting, e.g., from dust deposits.

What is claimed is:

1. Gas supply (3) for an electrostatic filter (2), which has an incoming flow channel (7) with constant cross-sectional area, a gas inlet hood (8) with cross-sectional area expanding in the direction of the electrostatic filter (2), and an admixture arrangement (19) for a conditioning means (20), wherein at least one flow distributor (10) is arranged in the expanded cross-sectional region of the gas inlet hood (8), characterized in that a first vortex arrangement (11) generating a leading-edge vortex (16) is arranged in the incoming flow channel (7), a second vortex arrangement (12) generating a leading-edge vortex (17) is arranged in the gas inlet hood (8) ahead of the flow distributor (10) in the direction of gas flow, and the admixture arrangement (19) is arranged in the region of the two vortex arrangements (11,12).

2. Gas supply according to claim 1, characterized in that the first vortex arrangement (11) is arranged before a bend (9) in the incoming flow channel (7) in the direction of main flow.

3. Gas supply according to claim 2, characterized in that the first vortex arrangement (11) is arranged closer to the inside (22) of the bend in the incoming flow channel than to the outside (21) of the bend.

4. Gas supply according to claim 2, characterized in that the first vortex arrangement (11) is arranged at an angle in the incoming flow channel (7), such that the incoming flow edge (14) of at least one incoming flow surface (13) facing the gas flow (5) points in the direction of the outside (21) of the bend and the separation edge (15) points towards the inside (22) of the bend in the incoming flow channel (7).

5. Gas supply according to claim 1, characterized in that the second vortex arrangement (12) is arranged in a lower region of the gas inlet hood (8).

6. Gas supply according to claim 1, characterized in that the second vortex arrangement (12) is arranged at an acute angle to a wall of the gas inlet hood (8).

7. Gas supply according to claim 1, characterized in that the admixture arrangement (19) opens behind the incoming flow edge (14) to a vortex arrangement (11,12).

8. Gas supply according to claim 1, characterized in that a vortex arrangement (11,12) has at least one vortex disk.

9. Gas supply according to claim 1, characterized in that a vortex arrangement (11,12) has several vortex disks arranged one next to the other in a flow cross section.

10. Gas supply according to claim 1, characterized in that a vortex arrangement (11,12) has several cascading vortex disks.

11. Gas supply according to claim 1, characterized in that a vortex arrangement (11,12) has a system composed of several vortex disks.

12. Electrostatic filter arrangement (1), which has an electrostatic filter (2) and a gas supply (3) according to any one of the preceding claims.

* * * * *

UNITED STATES PATENT AND TRADEMARK OFFICE

CERTIFICATE OF CORRECTION

PATENT NO. : 6,964,698 B1
DATED : November 15, 2005
INVENTOR(S) : Thomas Davis et al.

It is certified that error appears in the above-identified patent and that said Letters Patent is hereby corrected as shown below:

Title page,
Item [75], Inventors, replace "Bursheid (DE)" with -- Burscheid (DE) --.

Signed and Sealed this

Seventh Day of February, 2006

JON W. DUDAS
*Director of the United States Patent and Trademark Office*